US010619408B2

(12) United States Patent
Sander

(10) Patent No.: US 10,619,408 B2
(45) Date of Patent: Apr. 14, 2020

(54) LATCH FOR EXPANDABLE GATE

(71) Applicant: Evenflo Company, Inc., Miamisburg, OH (US)

(72) Inventor: David R. Sander, Liberty International, OH (US)

(73) Assignee: EVENFLO COMPANY, INC., Miamisburg, OH (US)

( * ) Notice: Subject to any disclaimer, the term of this patent is extended or adjusted under 35 U.S.C. 154(b) by 190 days.

(21) Appl. No.: 15/852,684

(22) Filed: Dec. 22, 2017

(65) Prior Publication Data

US 2019/0194977 A1 Jun. 27, 2019

(51) Int. Cl.

| | |
|---|---|
| ***E06B 9/02*** | (2006.01) |
| ***E06B 9/06*** | (2006.01) |
| ***E05B 65/00*** | (2006.01) |
| ***E05B 65/08*** | (2006.01) |
| *E06B 9/00* | (2006.01) |

(52) U.S. Cl.

CPC ..... *E06B 9/02* (2013.01); *E05B 65/0007* (2013.01); *E05B 65/0014* (2013.01); *E05B 65/0888* (2013.01); *E06B 9/0623* (2013.01); *E06B 9/0676* (2013.01); *E06B 2009/002* (2013.01)

(58) Field of Classification Search

CPC .. E06B 2009/002; E06B 9/02; E05B 65/0888; E05B 65/0014

See application file for complete search history.

(56) References Cited

U.S. PATENT DOCUMENTS

| | | | | |
|---|---|---|---|---|
| 2,490,612 A | | 12/1949 | Ballard | |
| 2,581,857 A | | 1/1952 | Harrison | |
| 2,859,811 A | * | 11/1958 | Rusch | E06B 9/0623 160/136 |
| 2,982,353 A | | 5/1961 | Luger | |
| 2,998,063 A | * | 8/1961 | Hafner | E06B 9/02 160/216 |
| 3,431,966 A | * | 3/1969 | Injeski | E06B 9/02 160/225 |
| 4,149,342 A | | 4/1979 | Bowers | |
| 4,339,099 A | | 7/1982 | Barton et al. | |
| 4,611,431 A | | 9/1986 | Lauro | |
| 4,677,791 A | | 7/1987 | Larson et al. | |
| 4,884,614 A | | 12/1989 | Spurling | |
| 5,134,806 A | | 8/1992 | Burkart, Jr. | |
| 5,396,732 A | | 3/1995 | Andersen | |
| 5,437,115 A | | 8/1995 | Freese et al. | |
| 5,457,914 A | | 10/1995 | Johnson, Jr. | |
| 5,632,514 A | | 5/1997 | Johnson, Jr. | |
| 5,657,809 A | | 8/1997 | Longoria et al. | |
| 5,685,582 A | | 11/1997 | McCartney | |
| 5,809,694 A | | 9/1998 | Postans | |

(Continued)

FOREIGN PATENT DOCUMENTS

JP 04-041885 A 2/1992

*Primary Examiner* — Justin B Rephann

(74) *Attorney, Agent, or Firm* — BakerHostetler

(57) ABSTRACT

A variable width gate adapted to be manipulated to secure the gate within the boundary of an opening, the gate comprising two gate members mounted for sliding movement with respect to each other and each having a lever associated therewith and a releasable locking member for locking the respective levers with respect to relative motion therebetween.

14 Claims, 5 Drawing Sheets

(56) References Cited

U.S. PATENT DOCUMENTS 5,865,485 A * 2/1999 Lawhorne, Jr. ..... E05C 19/003 292/258
5,890,320 A 4/1999 Andersen
5,924,242 A 7/1999 Macari et al.
6,119,754 A 9/2000 Okonsky
6,301,832 B1 10/2001 Andersen
6,308,462 B1 10/2001 Andersen
6,347,483 B1 2/2002 Andersen
6,370,823 B1 4/2002 Andersen
6,415,844 B1 7/2002 Smith
6,499,254 B2 12/2002 Rossman et al.
6,536,163 B1 3/2003 Monahan et al.
6,536,502 B2 3/2003 Britto et al.
6,595,498 B1 7/2003 Andersen
6,640,509 B2 11/2003 Clewis et al.
6,655,087 B2 12/2003 Andersen
6,935,436 B1 8/2005 Williston
8,261,490 B2 * 9/2012 Flannery ..... E06B 9/06 49/55
9,187,939 B1 * 11/2015 Bishop ..... E06B 9/01
9,222,300 B1 * 12/2015 Flannery ..... E06B 9/04
9,670,718 B2 * 6/2017 Yager Grad ..... E06B 9/06
2006/0027798 A1 2/2006 Winston
2007/0017156 A1 * 1/2007 Robinson ..... E04H 17/003 49/55
2007/0144691 A1 * 6/2007 Yates ..... E06B 9/04 160/377
2010/0290830 A1 * 11/2010 Cheng ..... E06B 9/02 403/290
2012/0324796 A1 * 12/2012 Wang ..... E06B 9/0623 49/421
2015/0075079 A1 * 3/2015 Sundberg ..... E06B 9/0638 49/465
2015/0089873 A1 * 4/2015 Marsden ..... E06B 9/02 49/56
2015/0267463 A1 * 9/2015 Yager Grad ..... E06B 9/06 49/465
2018/0313150 A1 * 11/2018 Buergermeister ..... E06B 9/02

* cited by examiner

LATCH FOR EXPANDABLE GATE

TECHNICAL FIELD

This invention relates to child and pet security gates, specifically to devices that enhance the safety and ease of use of frictional security gates.

BACKGROUND

The invention is directed mainly toward those types of security gates that are held in place by "frictional bumpers" on opposite sides of a passageway. Such a passageway typically would be a doorjamb, hallway or window jam. The security gate in question contains moveable parts which when properly adjusted create compressive forces which frictionally engages bumpers to opposite sides of an opening, holding the gate in place. This type of security gate therefore can be termed herein, as a "frictionally-held" security gate or a "pressure mounted" security gate.

One compression inducing mechanism, which is common in the current market place, involves two levers, one of which has a ring attached at the free end, the other lever of which has a uniform row of notches along its length. Rings have been made of solid pieces of bent metal or a composition of plates and rivets. The levers can be adjusted relative to each other by setting the ring into one of the notches and clamping the two levers together. This mechanism allows adjustment of the gate width with simultaneous adjustment of the compressive force which hold the gate in place. This type of mechanism can be termed herein, as a "lever-latch".

One condition observed with the use of lever-latch gates of this type is that in order for the pressure gate to maintain the desired frictional engagement with the walls (or other fixed surface such as a banister) on each side of the gate, the two levers that can be adjusted with respect to each other must be held in a fixed relationship in all three x, y and z coordinates (horizontal, vertical and inward/outward directions, respectively) when the gate is engaged. Conversely, it is also desired that the gate be designed in a manner that it may be easily disengaged for adjustment or removal.

SUMMARY

The present disclosure is directed to an expandable gate operative to selectively inhibit movement through an opening and, more specifically, to a latching mechanism for an expandable gate having a latch adapted to hold two lever arms of an expandable gate together in the x, y and z directions when engaged while being able to be released so that the latch may be slid in the x direction in order to adjust the width of the gate and to set or remove the gate as desired by a user. The latch preferably is comprised of an upper collar portion and a lower collar portion, each of which is shaped and sized to slidingly engage corresponding upper and lower lever arms of an expandable gate. Also preferably, the upper collar portion includes a hinged latch mechanism having a projection thereon.

It is a first aspect of the present disclosure to provide a variable width gate adapted to be manipulated to secure the gate within the boundary of an opening, the gate comprising: (a) an expandable gate; and (b) a locking mechanism to secure the expandable gate within a boundary of an opening, the mechanism comprising: (i) a first lever mounted to the expandable gate, (ii) a second lever mounted to the expandable gate and adapted to reciprocate with respect to the first lever, the second lever operative to generate a force expanding the expandable gate when reciprocated toward the first lever, and (iii) a locking mechanism mounted for sliding movement on one of the first lever or the second lever that selectively interacts with the other of the first lever or the second lever to substantially sustain the position of the first lever with respect to the second lever in the x, y and z coordinates to sustain the horizontal force for expanding the gate.

It is another aspect of the present disclosure to provide a method of sizing a variable width gate within an opening to inhibit through traffic, the method comprising the steps of: (a) pivoting a first lever with respect to a second lever, the first lever mounted to an expandable gate at a first position and the second lever mounted to the expandable gate at a second position, the pivoting of the first lever with respect to the second lever segment operative to change a width of the expandable gate; (b) orienting the first lever with respect to the second lever segment into a generally parallel orientation; and securing the first lever to the second lever to inhibit movement of the first lever with respect to the second lever.

It is yet another aspect of the present disclosure to provide a method of securing a gate within an opening to inhibit through traffic, the method comprising the steps of: (a) positioning an expandable gate within an opening having a width; (b) sizing a width of the expandable gate approximate the width of the opening; and (c) locking the expandable gate in place by wedging the expandable gate within the opening, where the locking step including the steps of: (i) positioning a first lever with respect to a second lever to include pivotally mounting the first lever to the second lever by a pivoted living hinge, the first lever being mounted to the expandable gate at a first position and the second lever being mounted to the expandable gate at a second position, and (ii) securing the first lever to the second lever to substantially inhibit the first lever from pivoting with respect to the second lever, the securing step including the use of a locking mechanism comprised of a first collar and a second collar adapted for sliding engagement with the first and second levers respectively.

These and other features and advantages of the present disclosure will become apparent to those skilled in the art upon consideration of the following detailed description of preferred embodiments exemplifying the best mode of carrying out the invention as presently perceived. The drawings are only to serve for reference and illustrative purposes, and are not intended to limit the scope of the disclosure.

BRIEF DESCRIPTION OF THE DRAWINGS

The detailed description that follows particularly refers to the accompanying figures in which.

DETAILED DESCRIPTION

The exemplary embodiments of the present invention are described and illustrated below as expandable gates or gate sections operative to occupy at least a portion of an opening to selectively inhibit movement therethrough. The various orientational, positional, and reference terms are used in an exemplary form to describe the elements of the inventions with respect to one another. However, for clarity and precision, only a single orientational or positional reference will be utilized and, therefore, it will be understood that the positional and orientational terms used to describe the elements of the exemplary embodiments of the present invention are only used to describe the elements in relation to one another and may be reconfigured by one of ordinary skill in the art without departing from the scope and spirit of the present invention.

Figure 1:
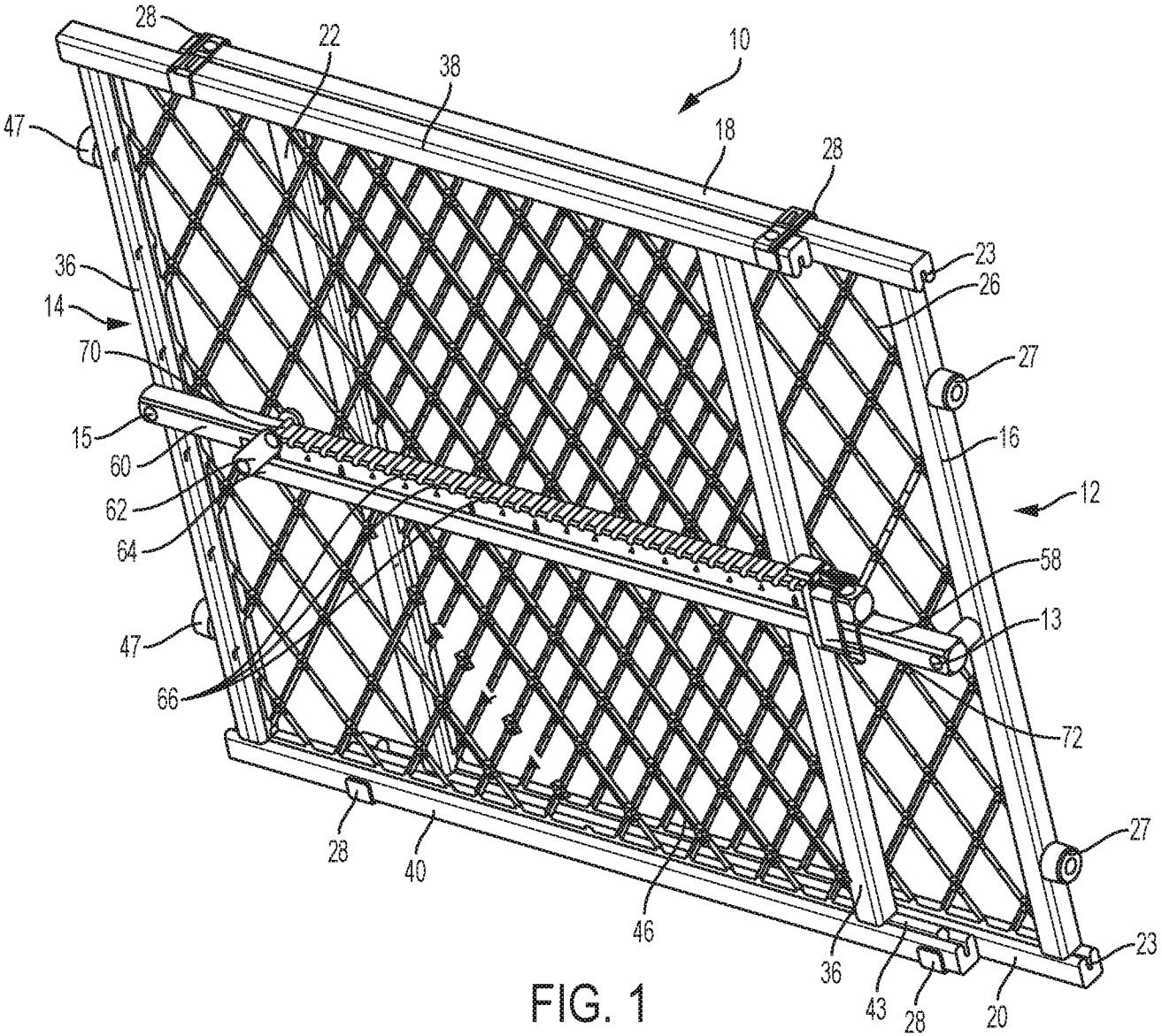
FIG. 1 is a perspective view of a pressure gate incorporating the latch mechanism of the present disclosure.
Figure 2:
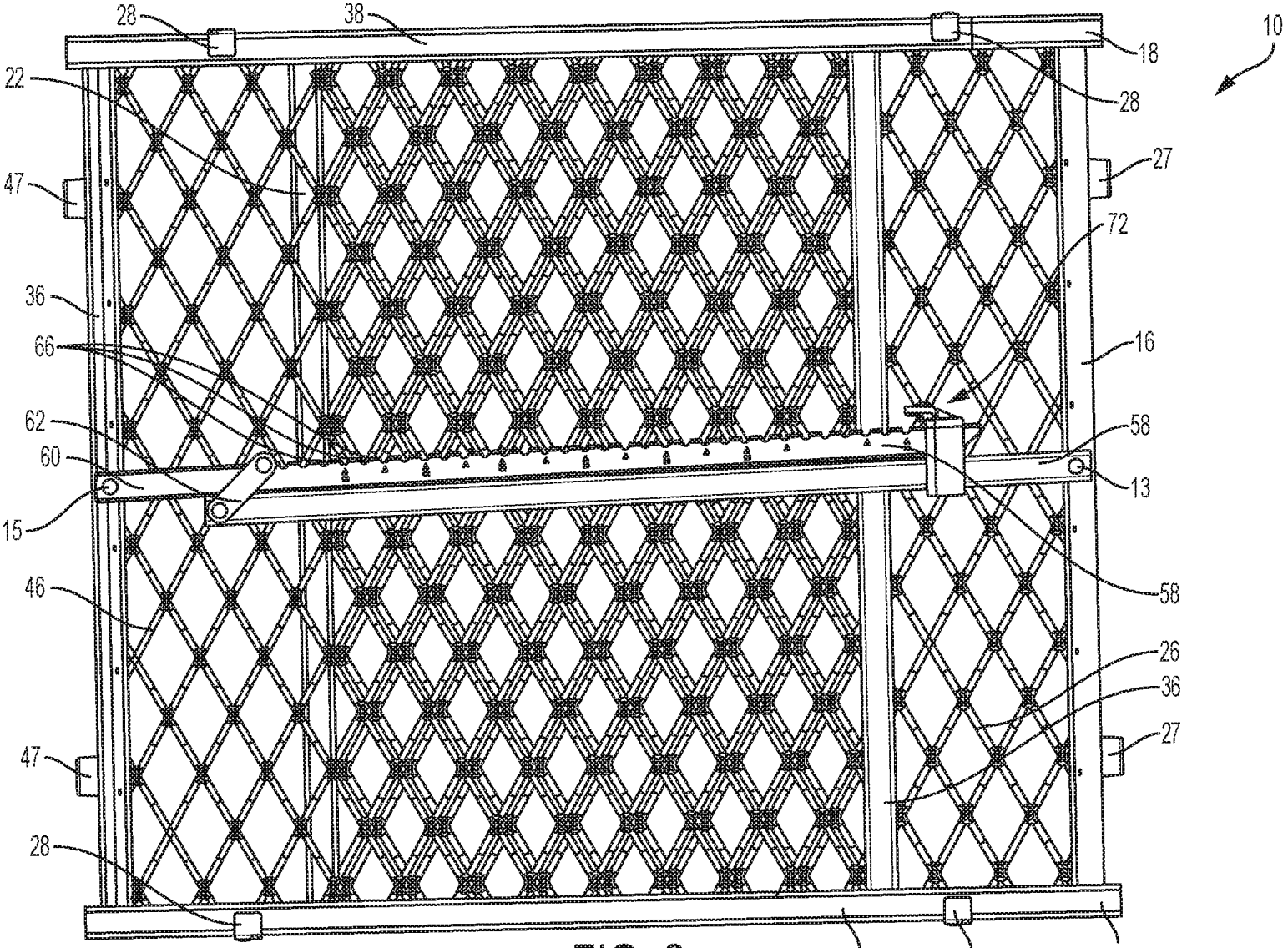
FIG. 2 is a front elevation view of the pressure gate of FIG. 1.
Figure 3:
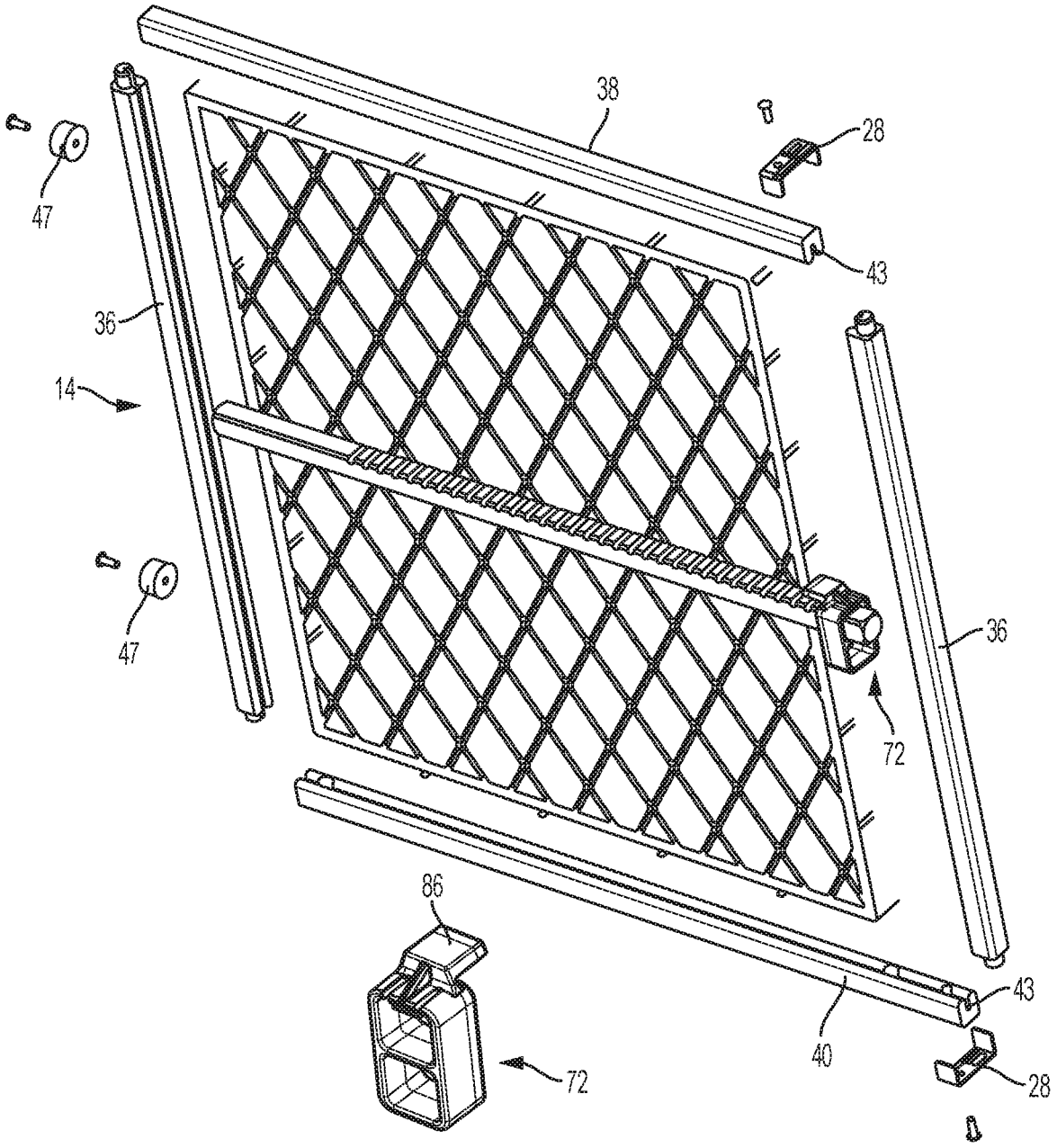
FIG. 3 is an exploded view of the left-side gate panel of the gate of of FIG. 1.

Referring to FIGS. 1-3, a first exemplary embodiment of an extendable gate 10 includes a first gate section 12 mounted to a second gate section 14. The first gate section 12 includes a right side frame member 16, a top frame member 18, a bottom frame member 20, and a left side frame member 22. Each frame member 16, 18, 20, 22 includes a channel 23 therein that runs the majority of the length of each frame member and is adapted to receive a pane 26 therein. The pane 26 may include any material that blocks a substantial portion of the opening defined by the frame members 16, 18, 20, 22, and in this exemplary embodiment includes plastic mesh. However, it is also within the scope of the invention to utilize other materials and panel designs, such as wire mesh, solid plastic panels, or solid panels with orifices therethrough. A pair of bumpers 27 are mounted to the right side frame member 16 that are adapted to contact a boundary, such as a wall, when the extendable gate 10 is secured within an opening. C-shaped fasteners 28 are utilized to mount the frame members 16, 18, 20, 22 to one another.

The second gate section 14 includes a right side frame member 36, a top frame member 38, a bottom frame member 40, and a left side frame member 42. Each frame member 36, 38, 40, 42 includes a channel 43 therein that runs at the majority of the length of each frame member and is adapted to receive a pane 46 therein. The pane 46 may include any material that blocks a substantial portion of the opening defined by the frame members 36, 38, 40, 42, and in exemplary form may be comprised of a plastic mesh material or the like. A pair of bumpers 47 are mounted to the left side frame member 42 that are adapted to contact a boundary, such as a wall, when the extendable gate 10 is secured within an opening. L-shaped fasteners 48 are utilized to mount the frame members 36, 38, 40, 42 together.

The gate 10 includes lower and upper lever 58, 60, each of which is mounted to the respective first and second gate sections 12, 14 and in particular the right side frame member 16 of first gate section 12 and left side frame member 42 of the second gate section 14 by pivots 13, 15 respectively. The lower lever 58 may include a pivoted loop 62 mounted approximate a free end 64 thereof. The upper lever may 60 may includes a plurality of notches 66 therein shaped to receive an upper portion 70 of the loop 62 therein. In an exemplary embodiment, the notches may be uniformly spaced apart a desired amount (such as a quarter inch apart) and may include widthwise markings corresponding to the approximate location of the upper portion 70 to properly bias the gate sections 12, 14 within an opening having a certain width. For instance, if the width of the opening is approximately thirty-six inches, a notch 66 would be labeled "36" indicating that a good starting point for securing the gate 10 within the opening would be to place the upper portion 70 of the loop 62 within the trough labeled "36" to create the proper bias for the lower and upper levers 58, 60.

Figure 4:
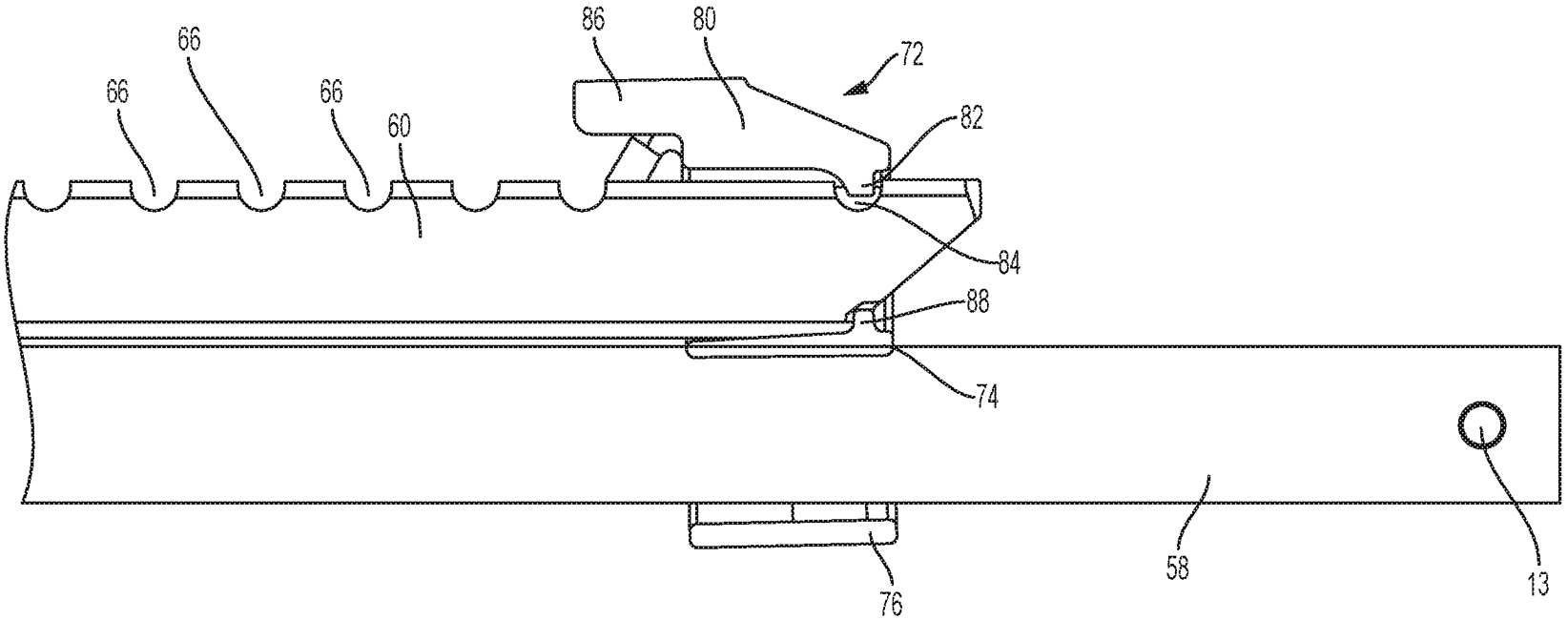
FIG. 4 is a partial cut-away side elevation view of the latch mechanism for a pressure gate in accordance with aspects of the present disclosure.
Figure 6:
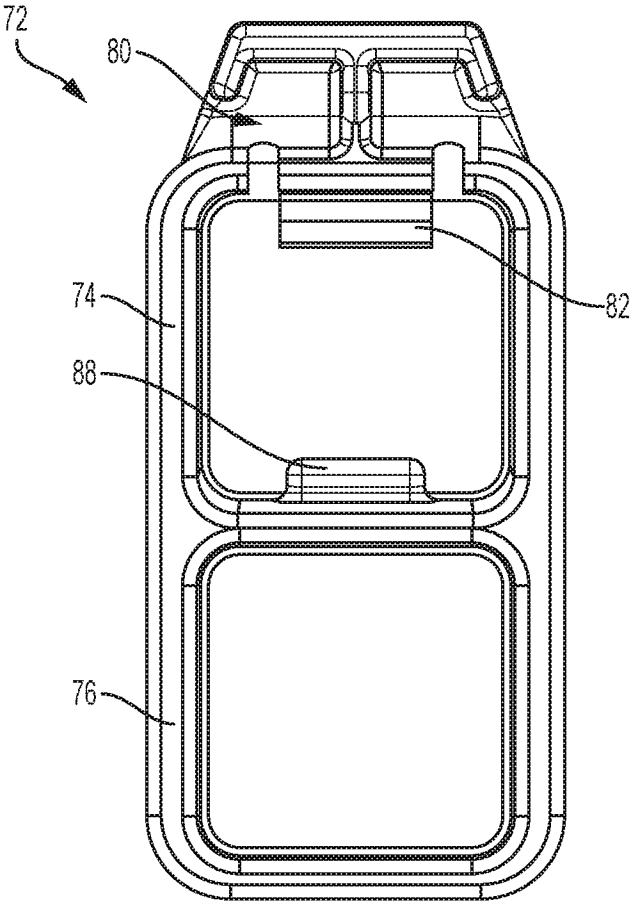
FIG. 6 is a front elevation view of the latch of FIG. 5.
Figure 5:
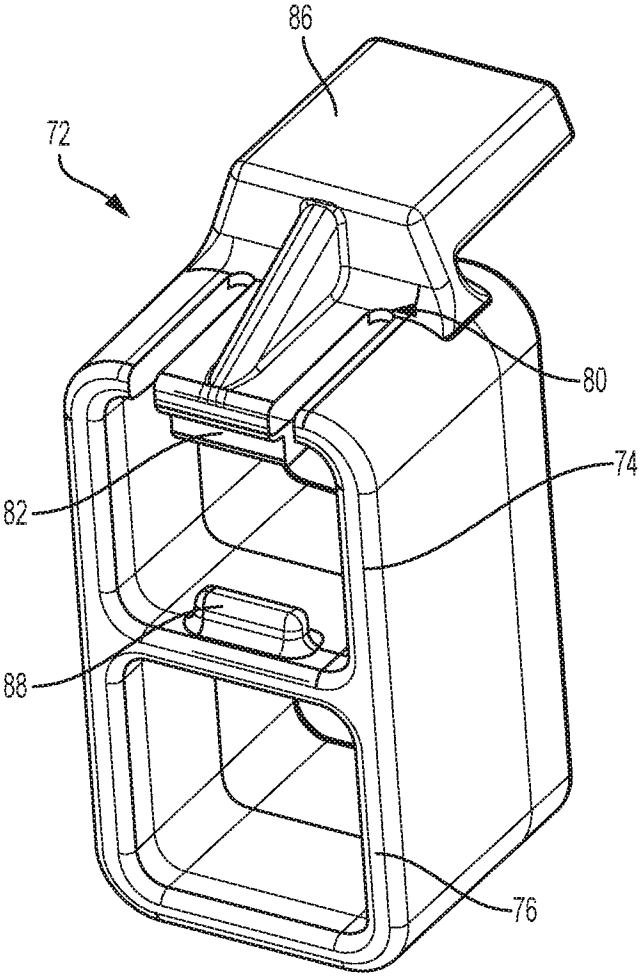
FIG. 5 is a front perspective view of the latch mechanism in accordance with aspects of the disclosure.

In accordance with an aspect of the disclosure, a locking mechanism 72 is provided for releasably locking the lower and upper levers 58, 60 with respect to each other in the x, y and z coordinates once the desired width of the gate 10 is reached. As shown in FIGS. 5 and 6, the locking mechanism 72 may be comprised of an upper collar 74 shaped to slidingly engage an end of the upper lever 60, a lower collar 76, shaped to slidingly engage the lower lever 58, and a release mechanism 78. In a preferred embodiment, the release mechanism 78 may be comprised of a hinged member 80 hinged to the upper collar 74 and having a projection 82 on and thereof shaped to be received in a corresponding notch 84 or other detent formed in the end of the upper lever 60. The hinged member 80 may include a thumb actuator 86 thereon to facilitate the engagement/disengagement of the locking mechanism 72 with the upper lever 60. Also in a preferred embodiment, as best shown in FIG. 4, the upper collar 74 may include a nub 88 on a lower portion thereof for engaging a bottom portion of upper lever 60 when the projection 82 is engaged with the notch 84 further preventing movement of the upper lever 60 in the x or horizontal direction.

In use, the gate 10, and the locking mechanism 72, may be operated by a user as follows. First, if not already accomplished, the locking mechanism 72, and in particular the lower collar 76 is slid in the x direction along the lower lever 58 such that the upper collar 74 is not engaged with the upper lever 60. Next, the extendable gate 10 is placed within an opening, possibly a doorway or between adjacent walls, such that the first gate section 12 is extended with respect to the second gate section 14 to position the bumpers 27, 47 in proximity to the boundary of the opening. As the gate sections 12, 14 are extended, the upper lever 60 traverses the lower lever 58 without the upper portion 70 of the loop 62 interacting with the notches 66. After the bumpers 27, 47 are in proximity to the boundary of the opening or are in contact with the boundary, the upper portion 70 of the loop 62 is positioned within one of the troughs 66.

After the upper portion 70 of the loop 62 is positioned within one of the notches 66, the upper lever 60 is pivoted with respect to the lower lever 58 until the upper lever 60 is parallel or almost parallel to lower lever 58, which action cams the bumpers 27, 47 against the opening. A user then pivots the hinged member 80 upward using the thumb actuator 86 and slides the locking mechanism 72 such that the upper collar 74 slides over the end of the upper lever 60. Then, when the projection 82 is positioned over the notch 84, the user releases the thumb actuator 86 allowing the hinged member 80 to pivot downwardly such that the projection 82 is received in the notch 84. As such, x (horizontal) movement is prevented by the interaction between the projection 82 and the notch 84. Further y and z (vertical and inward/outward) movement is prevented by the upper and lower collars, 74, 76, respectively thereby securing the gate 10 in the opening. When it is desired to remove the gate, a user simply depresses the thumb actuator 86 and slides the locking mechanism 72 such that the upper collar 74 becomes disengaged from the upper lever 60.

The various detailed embodiments described below are to be understood in the general context of the embodiment described above. Unless otherwise specified with respect to the detailed embodiments described below, the connection devices described below are constructed and operate in the manner described above.

While each of the embodiments described above employs a particular combination of novel features, it is within the scope of the invention to provide a connection device incorporating any one or more of the above-described features, including combinations of said features not specifically described herein. While preferred embodiments of the invention have been set forth above for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A variable width gate adapted to be manipulated to secure the gate within the boundary of an opening, the gate comprising:

a first panel section and a second panel section, the panel sections coupled to each other to allow each panel section to slide relative to the other panel section, the first panel section including an upper lever pivotally coupled thereto and the second section including a lower lever pivotally coupled thereto;

a locking member for releasably locking the first panel section with respect to the second panel section comprised of an upper collar shaped for sliding movement with respect to the upper lever, a lower collar, shaped for sliding movement with respect to the lower lever, the upper and lower collars being fixedly attached to each other, and a release mechanism for releasably preventing the upper and lower collars from sliding movement;

wherein the release mechanism comprises a hinged member, the hinged member including a projection thereon for engaging a detent on one of the upper and lower levers; and wherein the upper collar includes a nub on a lower portion thereof for engaging a bottom portion of the upper lever when the projection is engaged with the detent.

2. The variable width gate of claim 1 wherein said detent is a notch formed on a top of the upper lever.

3. The variable width gate of claim 1 wherein the first panel section and the second panel sections include bumpers on ends thereof.

4. The variable width gate of claim 1 wherein the hinged member includes a thumb actuator thereon.

5. The variable width gate of claim 1 wherein the detent is a notch.

6. The variable width gate of claim 1 wherein the lower lever includes a pivoted loop mounted thereto.

7. The variable width gate of claim 6 wherein the upper lever includes a plurality of notches thereon shaped to receive an upper portion of the loop.

8. The variable width gate of claim 7 wherein the notches are uniformly spaced apart.

9. The variable width gate of claim 8 wherein the upper lever includes widthwise markings thereon.

10. A variable width gate adapted to be manipulated to secure the gate within the boundary of an opening, the gate comprising:

a first panel section and a second panel section, the panel sections coupled to each other to allow each panel section to slide relative to the other panel section, the first panel section including an upper lever pivotally coupled thereto and the second panel section including a lower lever pivotally coupled thereto;

a locking member for releasably locking the first panel section with respect to the second panel section comprised of an upper collar shaped for sliding movement with respect to the upper lever, a lower collar, shaped for sliding movement with respect to the lower lever, the upper and lower collars being fixedly attached to each other, and a release mechanism, comprising a hinged member having a projection thereon for engaging a detent in the upper lever for releasably preventing the upper and lower collars from sliding movement; and wherein the upper collar includes a nub on a lower portion thereof for engaging a bottom portion of the upper lever when the projection is engaged with the detent.

11. The variable width gate of claim 10 wherein the first panel section and the second panel sections include bumpers on ends thereof.

12. The variable width gate of claim 10 wherein the hinged member includes a thumb actuator thereon.

13. The variable width gate of claim 10 wherein the lower lever includes a pivoted loop mounted thereto.

14. The variable width gate of claim 13 wherein the upper lever includes a plurality of notches thereon shaped to receive an upper portion of the loop.

* * * * *